US006564596B2

(12) United States Patent
Huang

(10) Patent No.: US 6,564,596 B2
(45) Date of Patent: May 20, 2003

(54) DOOR LOCK ASSEMBLY WITH MULTIPLE LATCH DEVICES

(75) Inventor: Chao-Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/207,061

(22) Filed: Jul. 30, 2002

(65) Prior Publication Data

US 2003/0070455 A1 Apr. 17, 2003

(30) Foreign Application Priority Data

Oct. 12, 2001 (TW) ..... 090217435

(51) Int. Cl.[7] ..... E05B 59/00; E05B 63/14

(52) U.S. Cl. ..... 70/107; 70/103; 70/113; 70/465; 242/34; 242/36; 242/37

(58) Field of Search ..... 70/103–107, 108, 70/109, 113–118, 120, 465; 292/34, 36, 37, 165, 170

(56) References Cited

U.S. PATENT DOCUMENTS 4,156,541 A * 5/1979 Babb et al. ..... 292/21
4,418,552 A * 12/1983 Nolin ..... 70/107
4,864,835 A * 9/1989 Wartian ..... 70/107
5,077,992 A * 1/1992 Su ..... 70/107
5,325,687 A * 7/1994 Lin ..... 70/107
5,544,507 A * 8/1996 Lin ..... 70/107
5,713,612 A * 2/1998 Kajuch ..... 292/36
5,878,606 A * 3/1999 Chaput et al. ..... 70/108
5,881,586 A * 3/1999 Shen ..... 70/107
5,911,763 A * 6/1999 Quesada ..... 70/120
6,128,933 A * 10/2000 Mirshafiee et al. ..... 70/107
6,217,087 B1 * 4/2001 Fuller ..... 292/39
6,334,636 B1 * 1/2002 Huang et al. ..... 292/144

* cited by examiner

*Primary Examiner*—Anthony Knight
*Assistant Examiner*—John B. Walsh
(74) *Attorney, Agent, or Firm*—Fei-Fei Chao; Venable, Baetjer, Howard & Civiletti, LLP

(57) ABSTRACT

A lock assembly has an outer cap, an inner cap, three latch devices and a transmitting device. The latch devices are mounted between the outer cap and the inner cap, and each has a cylinder and a bolt. An actuating shaft is connected to the first cylinder, and an inner handle is connected to the actuating shaft at one end of the actuating shaft corresponding to the inner cap. The transmitting device is connected to the cylinders of the latch devices to actuate the cylinders to an unlocked condition simultaneously. Accordingly, when the inner handle is rotated, the cylinders of the latch devices will be simultaneously unlocked.

5 Claims, 5 Drawing Sheets

DOOR LOCK ASSEMBLY WITH MULTIPLE LATCH DEVICES

BACKGROUND OF THE INVENTION

1. Field of the Invention

The present invention relates to a door lock assembly, and more particularly to a door lock assembly with multiple latch devices that can be simultaneously actuated to unlock from indoors.

2. Description of Related Art

A door is mounted with at least one lock to prevent an unauthorized person entering the premises. To improve the security feature, two or more locks are often simultaneously mounted on a door. However, when the conventional locks on the door are damaged, any person can pass through the door freely so that the security benefit is lost. In addition, for an authorized user to pass through the door, all the locks on the door must be unlocked firstly. It takes a lot of time to unlock the locks, particularly when multiple locks are fitted to combat increasing skill of thieves. This length of time is especially dangerous in an emergency such as a fire or earthquake when the occupants must leave the premises at the greatest possible speed.To overcome the shortcomings, the present invention tends to provide a lock assembly to mitigate or obviate the aforementioned problems.

SUMMARY OF THE INVENTION

The main objective of the invention is to provide a door lock assembly with multiple latch devices that can be unlocked simultaneously from indoors. The lock assembly has an outer cap, an inner cap, three latch devices and a transmitting device. The latch devices are mounted between the outer cap and the inner cap, and each has a cylinder and a bolt operationally connected to and actuated by the cylinder. An actuating shaft is connected to the first cylinder, and an inner handle is connected to the actuating shaft at one end of the actuating shaft corresponding to the inner cap. The transmitting device is connected to the cylinders of the latch devices to actuate the cylinders to an unlocked condition simultaneously. With such an arrangement, the cylinders of all latch devices will be simultaneously unlocked by means of rotating the inner handle. To unlock all of the latch devices just needs a little time, and the use of the lock assembly is convenient.

Other objects, advantages and novel features of the invention will become more apparent from the following detailed description when taken in conjunction with the accompanying drawings.

DETAILED DESCRIPTION OF PREFERRED EMBODIMENT

Figure 1:
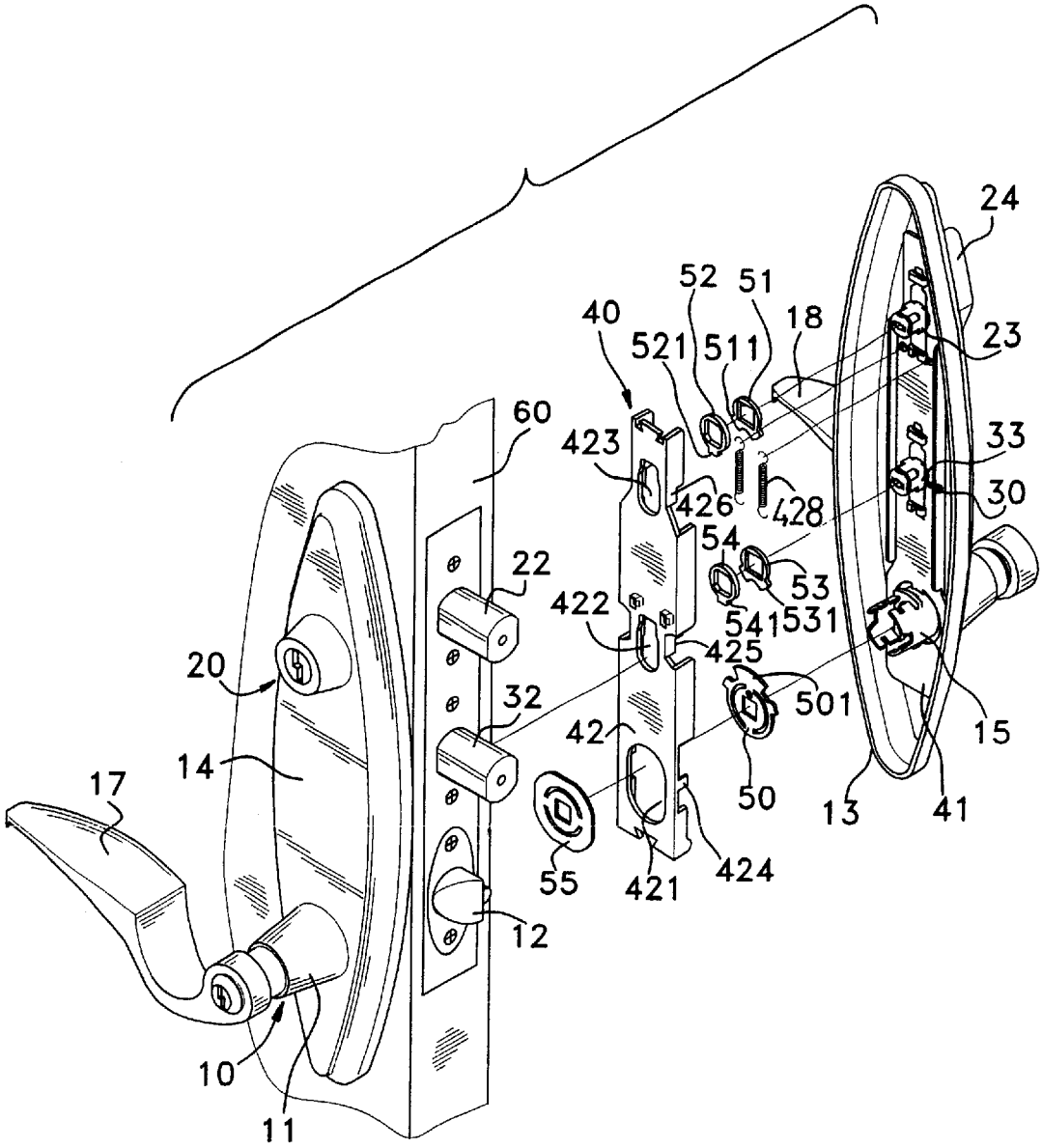
FIG. 1 is an exploded perspective view of a door lock assembly in accordance with the present invention.
Figure 2:
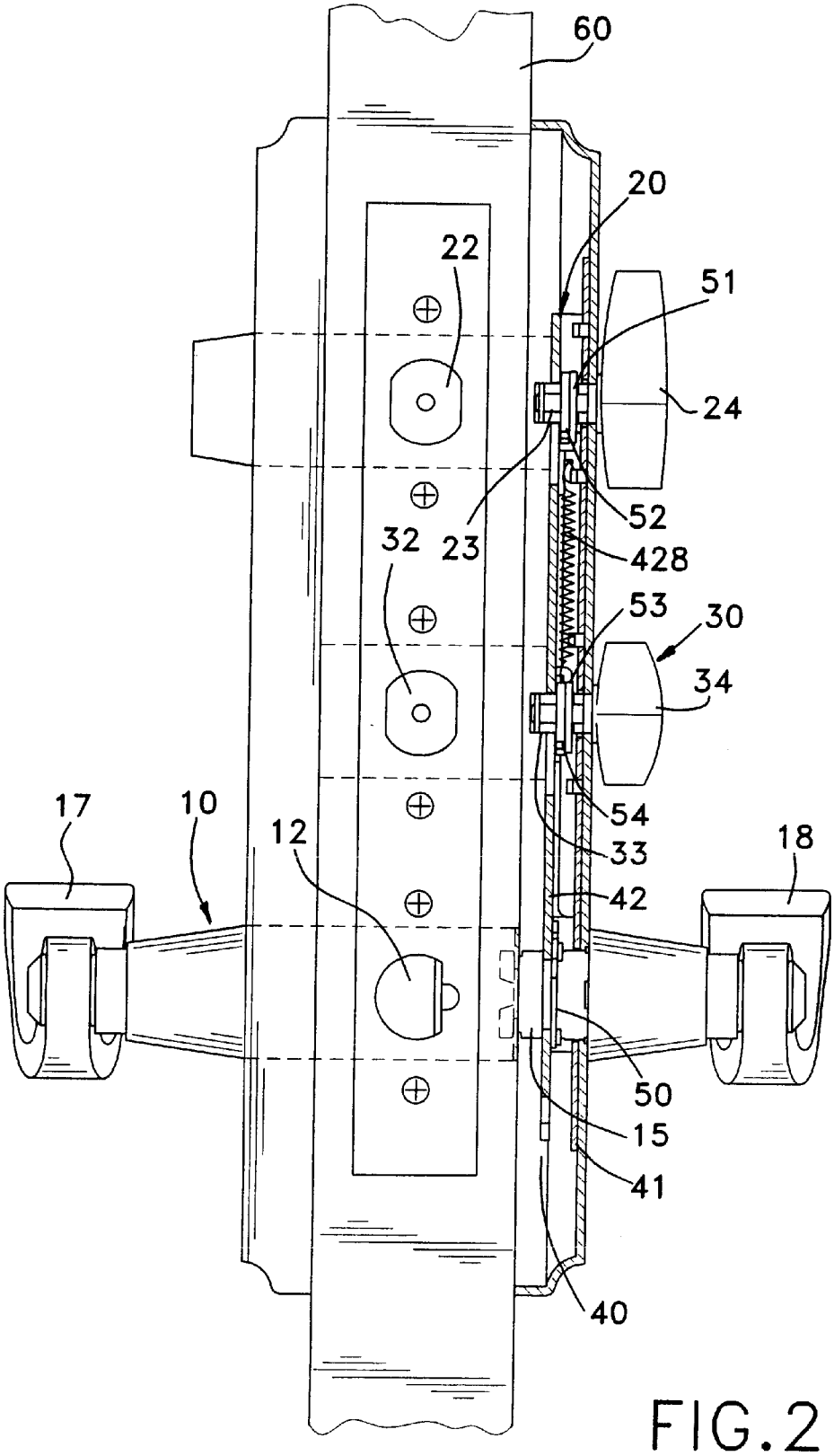
FIG. 2 is a side plan view in partial cross section of the door lock assembly in FIG. 1.
Figure 3:
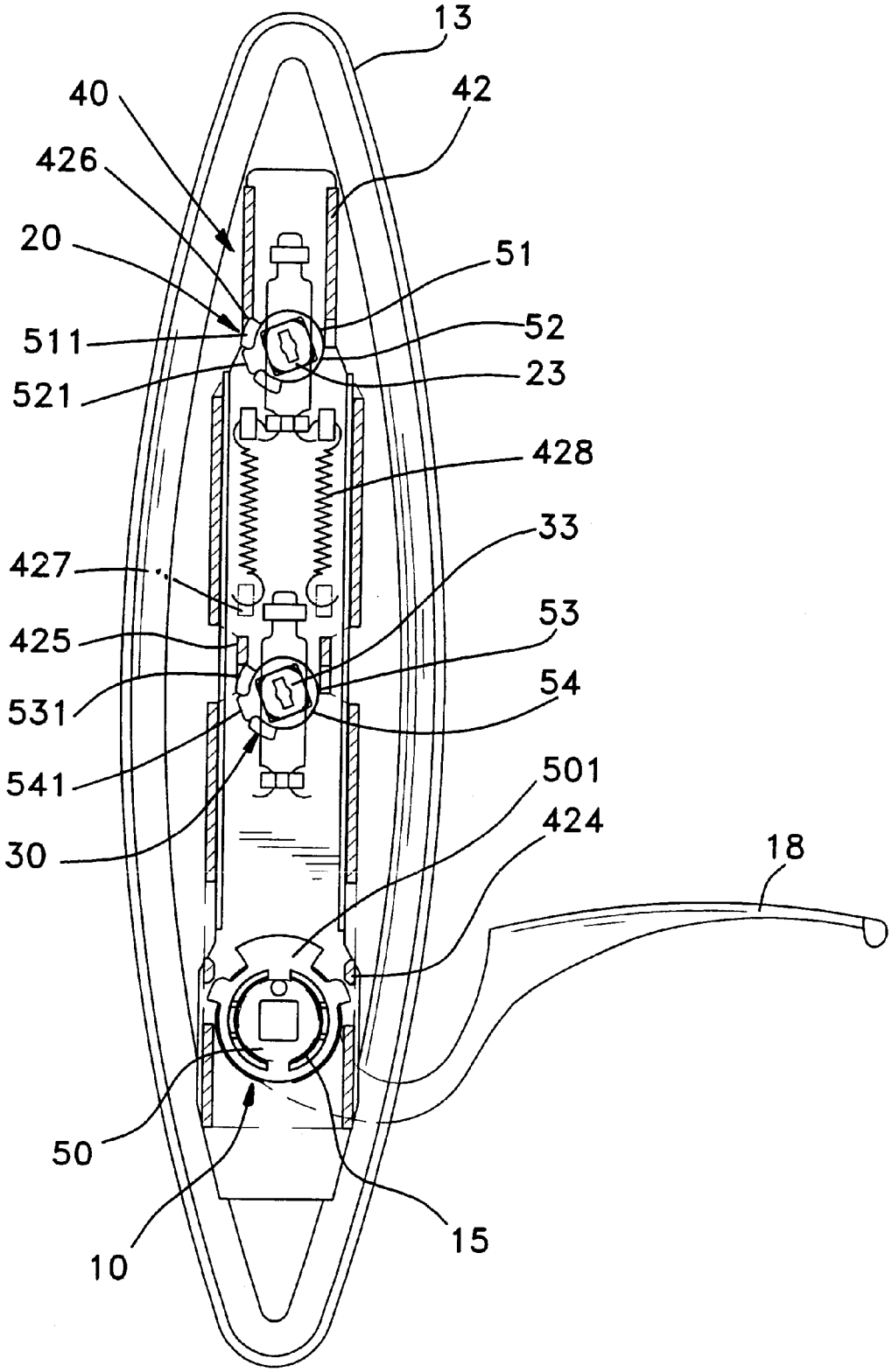
FIG. 3 is a front plan view in partial cross section of the door lock assembly in FIG. 1.
Figure 4:
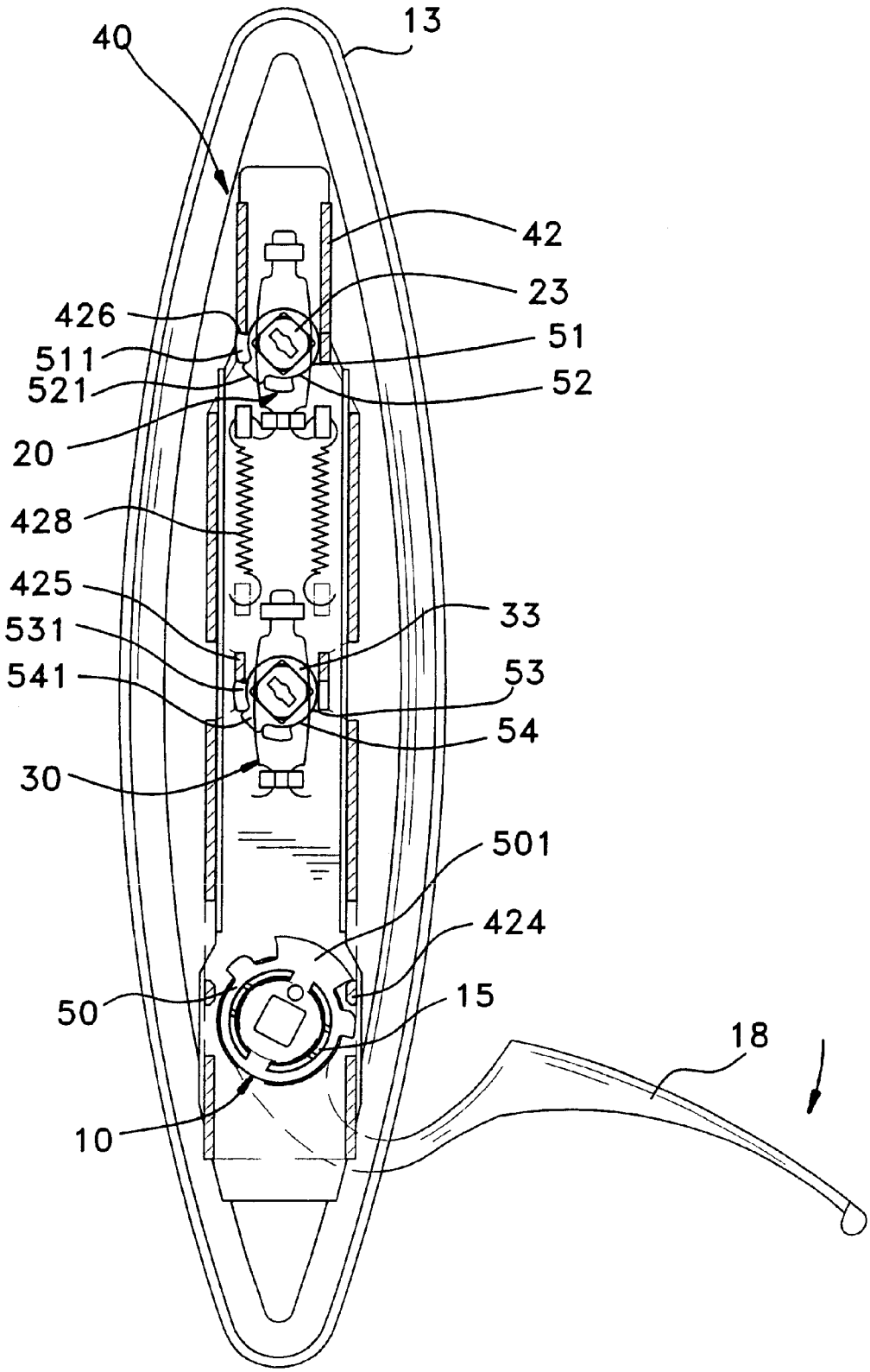
FIG. 4 is an operational front plan view in partial cross section of the door lock assembly in FIG. 1 showing that the inner handle is rotated at a small angle.
Figure 5:
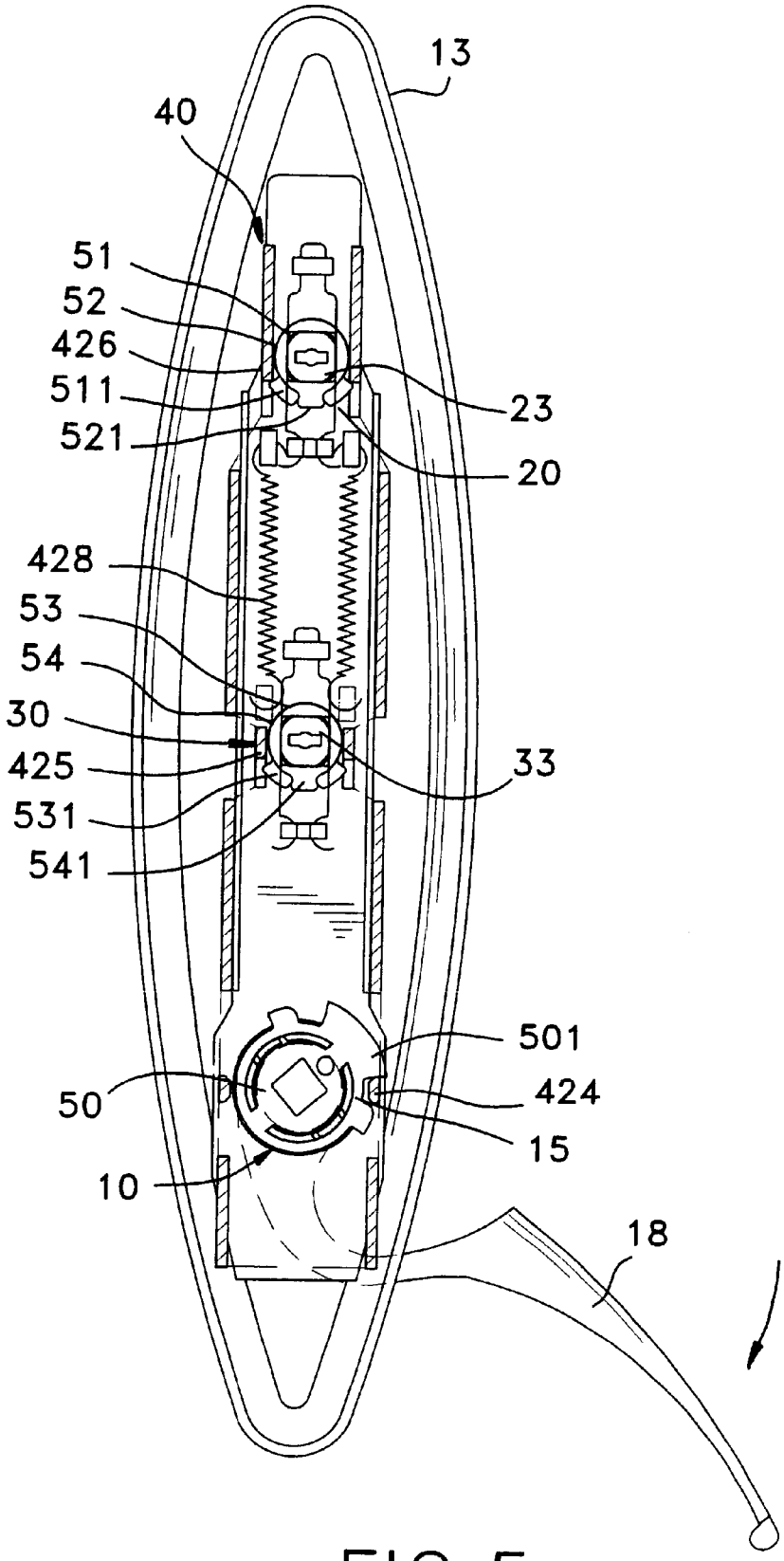
FIG. 5 is an operational front plan view in partial cross section of the door lock assembly in FIG. 1 showing that the inner handle is rotated at a large angle and all of the latch devices are unlocked simultaneously.

With reference to FIGS. 1 to 3, a door lock assembly in accordance with the present invention comprises an outer cap (14), an inner cap (13), three latch devices (10,20,30) and a transmitting device (40). The outer cap (14) is mounted on the outside of a door (60), and the inner cap (13) is mounted on the inside of the door (60) and corresponds to the outer cap (14). The latch devices (10,20,30) are mounted between the outer cap (14) and the inner cap (13), and each latch device (10,20,30) has a cylinder (11,23,33) mounted between the caps (13,14). Each latch device (10,20,30) has a bolt (12,32,22) connected to the corresponding one of the cylinders (11,23,33) and retractably extending out from the side of the door (60) to engage with a lock hole (not shown) defined in the doorframe. An actuating shaft (15) is rotatably mounted on the inner cap (13) and is connected to the first cylinder (11) of the first latch device (10). The first latch device (10) further has an inner handle (18) and an outer handle (17). The inner handle (18) is connected to the first cylinder (11) with the actuating shaft (15) at one end of the actuating shaft (15) corresponding to the inner cap (13). The outer handle (17) is connected to the first cylinder (11) at the end corresponding to the outer cap (14). Accordingly, when the inner handle (18) is rotated, the first cylinder (11) will be rotated to an unlock condition with the transmission of the actuating shaft (15). A keyhole (not numbered) is defined in the first cylinder (11) at the end corresponding to the outer cap (14) to fit with a corresponding key. When the key is inserted into the keyhole and is rotated, the first cylinder (11) will be actuated to rotate to an unlock condition. When the first cylinder (11) is unlocked, the first bolt (12) will draw back into the door and disengage with the corresponding lock hole by means of rotating the outer handle (17). Accordingly, the user can open the door (60) from outside.

The second latch device (20) has a knob (24) connected to the second cylinder (23) at one end corresponding to the inner cap (13). A keyhole (not numbered) is defined in the second cylinder (23) at the end corresponding to the outer cap (14) to fit with a corresponding key. Consequently, the user can lock or unlock the second latch device (20) by rotating the knob (24) from indoors or with the key from outdoors. When the second cylinder (23) is unlocked, the second bolt (22) will draw back into the door and disengage with the corresponding lock hole by means of rotating the knob (24) or the key.

The third latch device (30) has a control knob (34) connected to the third cylinder (33) at one end corresponding to the inner cap (13), but has no locking or unlocking structure at the end of the third cylinder (33) corresponding to the outer cap (14). Accordingly, the user can lock or unlock the third latch device (30) by rotating the control knob (34) from indoors, but nobody can lock or unlock the third latch device (30) from outdoors. This can prevent anybody from unlocking the lock assembly from outdoors and from unauthorized passage, such that an excellent anti-theft effect is provided.

The transmitting device (40) is mounted between the inner cap (13) and the outer cap (14) and is connected to the cylinders (11,23,33) of the latch devices (10,20,30) to actuate the cylinders (11,23,33) to be unlocked simultaneously. The transmitting device (40) has a fixed arm (41), a moving arm (42), an actuating plate (50), two actuated plates (51,53) and two elastic members (428). The fixed arm (41) is secured on the inner cap (13) for the actuating shaft (15), the second cylinder (23) of the second latch device (20) and the third cylinder (33) of the third latch device (30) extending through the fixed arm (41). The moving arm (42) is moveably mounted between the inner cap (13) and the outer cap (14). Three enlarged holes (421,422,423) are defined in the moving arm (42) and respectively moveably receive the actuating shaft (15), the second cylinder (23) and the third cylinder (33). Three pushing ears (424,425,426) perpendicularly extend from one side of the moving arm (42) and respectively correspond to the enlarged holes (421,422,423).

The actuating plate (50) is secured to the actuating shaft (15) and is located between the securing arm (41) and the moving arm (42). An actuating tab (501) protrudes from the actuating plate (50) and corresponds to the first pushing ear (424) corresponding to the actuating shaft (15).

The first actuated plate (51) is secured to the second cylinder (23) and is located between the securing arm (41) and the moving arm (42). An actuated tab (511) protrudes from the first actuated plate (51) and corresponds to the second pushing ear (426) corresponding to the second cylinder (23). The second actuated plate (53) is secured to the third cylinder (33) and is located between the securing arm (410 and the moving arm 42). An actuated tab (531) protrudes from the second actuated plate (53) and corresponds to the third pushing ear (425) corresponding to the third cylinder (33).

The elastic members (428) are securely mounted between the fixed arm (41) and the moving arm (42) to provide a recoil force to the moving arm (42). In practice, an upper hook (411) and a lower hook (427) are respectively mounted on the fixed arm (41) and the moving arm (42) for two ends of each elastic member (428) being securely attached to the hooks (411,427).

With reference to FIGS. 1 and 3 to 5, when the inner handle (18) is rotated, the actuating plate (50) will rotate with the actuating shaft (15) to push the first pushing ear (424) on the moving arm (42) with the actuating tab (501) and the moving arm (42) will move downward. The actuated plates (51,53) will be actuated to rotate by the second and the third pushing ears (426,425) while the moving arm (42) moves, such that the second cylinder (23) and the third cylinder (33) will be rotated with actuated plates (51,53) to an unlocked condition. The moving arm (42) and the inner handle (18) will move and rotate to the original position by the recoil force provided by the elastic members (428) after the inner handle (18) being released. Consequently, the cylinders (11,23,33) of all latch devices (10,20,30) will be simultaneously unlocked by means of rotating the inner handle (18). It just needs a little time to unlock all of the latch devices (10,20,30) from indoors, such that the use of the lock assembly is very convenient. Because the outer handle is not connected to the actuating shaft, the moving plate will not move while the outer handle is rotated.

In addition, two positioning plates (52,54) are respectively mounted on the second and the third cylinders (23,33) and are respectively located between the moving arm (42) and the corresponding actuated plates (51,53). A positioning tab (521,541) protrudes from each respective positioning plate (52,54) and abuts the corresponding one of the pushing ears (425,426). Consequently, the original position of the cylinders (23,33) can be precisely achieved by means of the abutment between the positioning tabs (521,541) and the corresponding pushing ears (425,426). A securing plate (55) is securely attached to the actuating shaft (15) at the side of the moving arm (42) far from the actuating plate (50), such that the moving arm (42) is sandwiched between the actuating plate (50) and the securing plate (55). With the arrangement of the securing plate (55), the movement of the moving arm (42) is smooth.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A door lock assembly comprising:

an outer cap adapted to be mounted on a first side of a door;

an inner cap corresponding to the outer cap and adapted to be mounted on a second side of the door;

a first latch device mounted between the outer cap and the inner cap and having:

a first cylinder rotatably mounted between the outer cap and the inner cap;

a first bolt operationally connected to and actuated by the first cylinder and adapted to engage with a first lock hole defined in a door frame;

an actuating shaft rotatably mounted on the inner cap and connected to the first cylinder;

an inner handle connected to the actuating shaft at one end of the actuating shaft corresponding to the inner cap; and a key hole defined in the first cylinder at one end corresponding to the outer cap;

a second latch device mounted between the outer cap and the inner cap and having:

a second cylinder rotatably mounted between the outer cap and the inner cap;

a second bolt operationally connected to and actuated by the second cylinder and adapted to engage with a second lock hole defined in the door frame;

a knob connected to the second cylinder at one end corresponding to the inner cap; and a key hole defined in the second cylinder at one end corresponding to the outer cap;

a third latch device mounted between the outer cap and the inner cap and having:

a third cylinder rotatably mounted between the outer cap and the inner cap;

a third bolt operationally connected to and actuated by the third cylinder and adapted to engage with a third lock hole defined in the door frame; and a control knob connected to the third cylinder at one end corresponding to the inner cap a transmitting device mounted between the inner cap and the outer cap and connected to the cylinders of the latch devices to actuate the cylinders to an unlocked condition simultaneously, the transmitting device having:

a fixed arm secured on the inner cap for the actuating shaft, the second cylinder of the second latch device and the third cylinder of the third latch device extending through the fixed arm;

a moving arm moveably mounted between the inner cap and the outer cap, the moving arm having three enlarged holes respectively moveably receiving the actuating shaft, the second cylinder and the third cylinder and three pushing ears perpendicularly extending from one side of the moving arm and respectively corresponding to the enlarged holes;

an actuating plate secured to the second cylinder and located between the securing arm and the moving arm, the actuating plate having an actuating tab protruding from the actuating plate and corresponding to a first pushing ear corresponding to the actuating shaft;

a first actuated plate secured to the second cylinder of the second latch device and is located between the securing arm and the moving arm, the first actuating plate having an actuated tab protruding from the first actuated plate and corresponding to a second pushing ear corresponding to the second cylinder;

a second actuated plate secured to the third cylinder of the third latch device and located between the securing arm and the moving arm, the second actuated plate having an actuated tab protruding from the second actuated plate and corresponding to a third pushing ear corresponding to the third cylinder; and at least one elastic member securely mounted between the fixed arm and the moving arm to provide a recoil force to the moving arm.

2. The door lock assembly as claimed in claim 1 further comprising an outer handle connected to the first cylinder at one end corresponding to the outer cap.

3. The door lock assembly as claimed in claim 1 further comprising a first positioning plate mounted on the second cylinder and located between the moving arm and the first actuated plate, the first positioning plate having a positioning tab protruding from the first positioning plate and abutting the second pushing ear; and a second positioning plate mounted on the third cylinder and located between the moving arm and the second actuated plate, the second positioning plate having a positioning tab protruding from the second positioning plate and abutting the third pushing ear.

4. The door lock assembly as claimed in claim 1 further comprising a securing plate securely attached to the actuating shaft at a side of the moving arm far from the actuating plate to sandwich the moving arm between the actuating plate and the securing plate.

5. The door lock assembly as claimed in claim 2, wherein the fixed arm has an upper hook formed on the fixed arm for one end of each respective at least one elastic member being securely attached to the upper hook; and the moving arm has a lower hook formed on the moving arm for the end of the at least one elastic member being securely attached to the lower hook.

* * * * *